United States Patent [19]

Alvers

[11] Patent Number: 4,879,974

[45] Date of Patent: Nov. 14, 1989

[54] CRANKCASE SUPERCHARGED 4 STROKE, 6 CYCLE ENGINE

[76] Inventor: Gary M. Alvers, 228 S. Jackson 2A, Red Bluff, Calif. 96080

[21] Appl. No.: 167,490

[22] Filed: Mar. 14, 1988

[51] Int. Cl.[4] ..... F02B 25/08

[52] U.S. Cl. ..... 123/51 A; 123/59 A; 123/65 VD; 123/73 PP

[58] Field of Search ..... 123/64, 65 VD, 65 WA, 123/65 P, 73 PP, 51 A, 53 R, 53 A, 57 A, 59 A, 73 B

[56] References Cited

U.S. PATENT DOCUMENTS

| | | | |
|---|---|---|---|
| 1,031,246 | 8/1912 | Claus | 123/73 CC |
| 1,234,039 | 11/1917 | Kessler | 123/76 |
| 1,267,128 | 4/1918 | Seguin | 123/79 |
| 1,396,045 | 7/1921 | Mellen | 123/60 |
| 3,672,172 | 6/1972 | Hammond | 123/317 |
| 3,756,206 | 9/1973 | Gommel | 123/317 |
| 3,973,532 | 8/1976 | Litz | 184/6.8 |

FOREIGN PATENT DOCUMENTS

| | | | |
|---|---|---|---|
| 280597 | 12/1930 | Italy | 123/73 A |
| 431101 | 2/1948 | Italy | 123/73 A |
| 0035816 | 4/1978 | Japan | 123/65 VD |
| 66474 | 7/1943 | Norway | 123/73 A |
| 421896 | 1/1935 | United Kingdom | 123/73 A |

*Primary Examiner*—David A. Okonsky

[57] ABSTRACT

A high power, fuel efficient, low-emission, four-stroke, 6 cycle method of operation. A primary intake conduit carries air or a lean mixture from the compression chamber (crankcase) to the combustion chamber. Fuel is added to the air or lean mixture as it passes through the intake conduit. A secondary intake conduit runs from the compression chamber to ports in the cylinder located slightly above the bottom dead center position of the piston. Supplemental air or lean mixture from the compression chamber is fed to the combustion chamber through the secondary conduit when the piston is near its bottom dead center position. While the piston is in its bottom dead center position between its intake and compression strokes, the air or lean mixture from compression chamber provides a stratified charge in the combustion chamber, which is far more efficient than a homogeneous mixture, and has the further benefit of filling the cylinder from the bottom as well as from the top. This puts air/air fuel mixture into a space that is normally unable to be filled in the medium and high speed ranges due to the vacuum created above the piston by its rapid downward movement. This results in a noticeable increase in volumetric efficiency. Air lean mixture is also injected into the combustion chamber through the secondary intake conduit when the piston is between its power and exhaust strokes to further enhance complete combustion.

16 Claims, 8 Drawing Sheets

CRANKCASE SUPERCHARGED 4 STROKE, 6 CYCLE ENGINE

BACKGROUND OF THE INVENTION

In the last 20 years or so, the internal combustion engine, both 2 cycle and 4 cycle alike have reached the peak of their development. The last few years have been devoted to squeezing out the last little bit of efficiency from a tired design.

Through the combining of systems, methods, and techniques from both the 2 cycle and 4 cycle engine, a new engine is born . . . the crankcase supercharged, 4 stroke, 6 cycle, internal combustion engine. A new method of combustion with a potential that promises to dramatically exceed present levels of performance in virtually every area. In order to fully understand the far reaching implications of this new design, you must first start thinking in unlimited terms.

Imagine if you will, what the most logical characteristics of a truly ultimate engine would be. This ultimate engine should be of a simple design. Therefore, being more dependable and cost efficient to produce. It should also have a broad power band and be able to respond powerfully in any speed range while at the same time making the most efficient use of every drop of fuel. Thus, resulting in superior fuel economy and greatly reduced emissions. All these characteristics must be accomplished through the engines ability to achieve a more complete combustion within itself. Thus, eliminating the need to drive all the elaborate emission control devices that have complicated, detuned, and choked down the engines of today. These many complicated systems and devices that have been employed on todays engines represent an effort to deal with the basic inability to achieve a complete and efficient combustion within itself. This approach to deal with inefficiency is for the most part eneffective, because it largely deals with the effect rather than the cause. This type of logic has over complicated the combustion engine, causing undue expense to the manufacturer, and been a plague to the mechanic and consumer alike.

The crankcase supercharged, 4 stroke, 6 cycle, internal combustion engine is not some radical departure from the present methods of combustion, but an evolutionary hybrid that transcends the design limitations of both 2 cycle and 4 cycle engines by combining the best aspects of the two present methods of combustion, creating the new 6 cycle method of operation. The systems, processes, and techniques that go together to make-up the 6 cycle method of operation are not new in themselves. It is the special way that they are combined with each other that produces this new 6 cycle method of operation. Wherein, the lower portion of the engine operates on a 2 stroke method of operation intake and compression; while the upper portion of the engine operates on a 4 stroke method of operation comprising of intake, compression, power, and exhaust (strokes not to be confused with cycles or events.) This method represents a new unifying 6 cycle theory of operation born of the marriage between the 2 cycle and 4 cycle engines. This new method allows the natural and logical combining of the best processes, systems, and techniques for causing and enhancing the combustion process. Combining them in such a way, as to create, a smooth and efficient relationship between its mechanical movement and the overlaping combustion processes, cycles and events.

The 6 cycle design incorporates a self-supercharging feature. By utilizing the natural movement and momentum of parts already in motion, it is able to cause a positive pressure to be produced in the crankcase and intake manifold. It develops a stratified fuel mixture and does this by feeding the cyclinder from both ends. Therefore, vastly increasing volumetric efficiency by inducing pressurized air into a normally vacuumized area of the cyclinder. A superior air injection emission control system and purging cycle are also incorporated into this method of operation. This is accomplished in the simplest of ways within the design of the engine without having to drive or run, any external pumps, systems, or power robbing apparatus using parts that are already being made and systems that have already been proven.

SUMMARY OF THE INVENTION

The present invention provides a supercharged, four-stroke, 6 cycle engine, with high power, superior fuel economy, and low-emissions. A piston which reciprocates through successive intake, compression, power and exhaust strokes respectively divides a chamber into a combustion chamber and a compression chamber. Air, or air mixed with a small quantity of fuel (a lean mixture), is supplied to the compression chamber during the compression and exhaust strokes of the piston. An intake conduit provides fluid communication between the compression chamber and the combustion chamber, and a compression chamber outlet valve prevents reverse flow from the intake conduit to the compression chamber. An active intake valve allows fluid communication from the fluid conduit into the combustion chamber during the intake stroke of the piston.

Fuel is mixed with the air, or lean mixture, as it passes from the compression chamber to the combustion chamber through the intake conduit. This fuel provides a combustible charge which is injected into the combustion chamber at greater than atmospheric pressure during the intake stroke of the piston and further compressed in the combustion chamber by movement of the piston during the compression stroke.

At least one secondary conduit provides fluid communication from the compression chamber to the interior of the combustion chamber through a secondary port. The secondary port is located so that it is blocked by the piston, except near its bottom dead center position. Supplemental air from the compression chamber, or the lean mixture, is fed into the combustion chamber immediately above the piston at the end of the intake stroke and beginning of the compression stroke through the secondary port. In addition, air, or the lean mixture, is fed into the combustion chamber through the secondary port at the end of the power stroke and beginning of the exhaust stroke.

The primary and secondary intake conduits of the present invention provide a relatively rich mixture distant from the piston, and a relatively lean mixture adjacent the piston. This type of mixture distribution is called a "stratified charge." Combustion ordinarily commences remote from the piston. To initiate combustion, a mixture is required which is relatively more rich than the optimum mixture for complete combustion. The present invention provides a richer mixture where combustion commences to facilitate the initiation of combustion, then progressively leaner mixture is encountered burning more efficiently and completely. More complete combustion results in greater fuel economy, more power, and less pollution.

The extra air or lean mixture fed into the combustion chamber at the end of the power stroke and beginning of the exhaust stroke, provides additional oxidant to complete combustion, lowering unwanted emissions. In addition, this injection of air or lean mixture, proximate the piston provides a "cushion" of uncombusted material immediately above the piston which facilitates complete exhaustion of the combusted charge.

In addition to providing a stratified charge and reducing emissions, the secondary conduits of the present invention also serve to relieve excess pressure in the compression chamber. When the engine speed is relatively high, the pressure within the compression chamber at the end of the intake stroke of the piston will be substantially greater than atmospheric. Accordingly, when the next cycle starts, there will be a delay in the intake of air or lean mixture into the compression chamber itself. The secondary conduits lower this back pressure, and thus decrease the delay in refilling the compression chamber with fresh air or lean mixture. This has been found to be particulary critical at speeds above about 6500 rpm where the dynamic effects of flow through the intake conduit are a significant limiting feature on performance of the engine unless the secondary conduits are employed.

The present invention contemplates the use of either air alone, or a relatively lean mixture of fuel and air, in the compression chamber. The lean mixture may be desirable to eliminate possible hot spots that may occur from inadequate mixing of pure air injected into the combustion chamber, and provides more control over the stratified charge. However, use of pure air eliminates the need for a second fuel mixing system and is the more desirable embodiment.

In a preferred embodiment of the present invention, a pair of pistons and cylinders are used which define discrete combustion chambers and may have separate compression chambers or, open to a common compression chamber. The pistons operate in unison but their stroking operations are offset so that one piston is on its intake stroke while the other piston is on its power stroke. A common intake conduit leads from the compression chamber to both combustion chambers. The intake conduit, thus alternately feeds one combustion chamber and then the other, to provide a relatively constant flow of fluid through the intake conduit. This avoids the alternating stagnation and loss of intake track velocity found in the conduit when only a single cylinder engine is employed.

The novel features which are characteristic of the invention as to organization, and method of operation, together with further objects and advantages thereof, will be better understood from the following description considered in connection with the accompanied drawings which a preferred embodiment of the invention is illustrated by way of example. It is to be expressly understood, however, that the drawings are for the purpose of illustration and description only, and are not intended as a definition of the limits of the invention.

DESCRIPTION OF THE PREFERRED EMBODIMENTS

Figure 1:
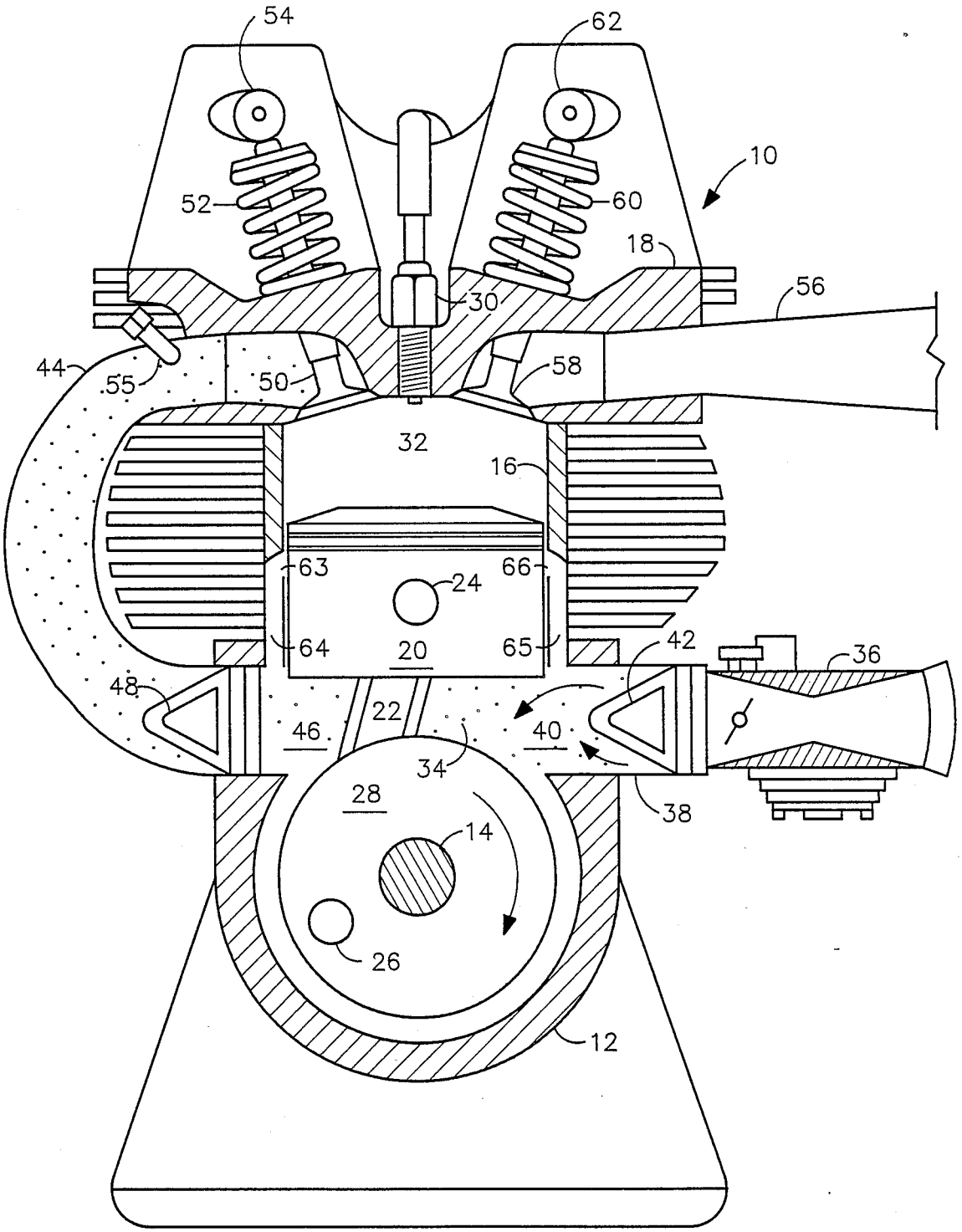
FIG. 1 is a sectional elevation view of the engine of the present invention.

The primary elements of the engine 10 of the present invention are illustrated by way of reference to FIG. 1. Engine 10 includes a crankcase 12 enclosing a crank 14. A cylinder 16 is mounted to crankcase 12, and a cylinder head 18 is mounted to the cylinder. A piston 20 reciprocates within cylinder 16. Piston rod 22 depends from piston 20 and is pivotably attached thereto at 24. Piston rod 22 is also attached at 26 to a web 28 mounted to crankshaft 14. Since position 26 is offset from the axis of rotation of crankshaft 14, reciprocation of piston 20 within cylinder 16 causes rotation of crankshaft 14. The ends of the piston travel, are generally related to the movement of position 26, and it is customary to refer to the extreme up and down positions of piston 20 as top dead center and bottom dead center respectively. The intermediate positions of the piston are described in terms of degrees of rotation of crankshaft 14 from one of its extreme (bottom or top dead center) positions.

If engine 10 is to be a gasoline engine, a spark plug 30 is provided to ignite a combustible mixture. However, no such ignition device need be used if the engine is to operate as a diesel engine. But, the compression ratio in the combustion cylinder must be increased.

Crankcase 12, cylinder 16 and cylinder head 18, together with associated valves to be discussed in more detail later, provide a closed chamber. Piston 20 divides this enclosed chamber into a combustion chamber 32 located above the piston and a compression chamber 34 located below the piston. The respective volumes of the combustion chamber 32 and compression chamber 34 are controlled by movement of piston 20.

A carburetor, fuel injector, or other fuel mixing device may be used to provide a lean fuel/air mixture to compression chamber 34. Fuel mixing device 36 can be a conventional Venturi carburetor as illustrated, or other type of fuel mixing system such as a fuel injector. Carburetor 36 is attached to a conduit 38 mounted to crankcase 12 and cylinder 16. A port 40 is provided so that conduit 38 opens into combustion chamber 34. A reed valve 42 or other type of check valve is located within conduit 38 so that the lean mixture can flow into compression chamber 34 but is prevented from escaping therefrom. Valve 42 is preferably a passive valve, i.e., a check-valve, to minimize the complexity of engine 10, but in some applications it may be desirable to use an active, i.e., externally actuated valve instead. If air alone is to be supplied to compression chamber 34, carburetor 36 is not used, but is replaced with an air throttle.

An intake conduit 44 has one end attached to a crankcase 12 and cylinder 16, and an opposite end attached to cylinder head 18. A port 46 provides fluid communication from compression chamber 34 to the interior of intake conduit 44, and a reed valve 48 or other type of check valve prevents the flow of any fluid from the intake conduit back into the compression chamber. Again, valve 48 is preferably a passive valve, but an active valve may be desirable in some situations Intake poppet valve 50 with its associated valve spring 52 and cam actuator 54 provide an active valving mechanism at the downstream end of intake conduit 44 leading into combustion chamber 32.

A fuel injector 55 is located proximate the downstream end of intake conduit 44 in the embodiment illustrated. Fuel injector 55 mixes fuel with the material passing through the intake conduit. If air alone is fed to compression chamber 34, injector 55 provides sufficient fuel so that a readily ignitable combustible charge is fed into combustion chamber 32. If a charge generating device 36 is used to provide a lean mixture to compression chamber 34, injector 55 enriches the mixture sufficient so that the charge provided to the upper portion of combustion chamber 32 can be readily ignited. A carburetor or other type of fuel mixing device could also be used in place of a fuel injector, and the point at which the fuel is added between compression chamber 34 and combustion chamber 32 may not be critical.

An exhaust conduit 56 emanates from cylinder head 18. At exhaust poppet valve 58 together with its associated valve spring 60 and cam actuator 62 control the exhausting of gasses from combustion chamber 32.

Supplemental intake conduits 64, 65 are provided in the sidewall of cylinder 16, and terminate in ports 63, 66 in cylinder 16. Conduits 64, 65 provide fluid communication from compression chamber 34 to a position just above the bottom dead center position of piston 20. As a result, when piston 20 is at or near its bottom dead center position, communication is provided from compression chamber 34 to combustion chamber 32 through conduits 64, 65.

Figure 2A:
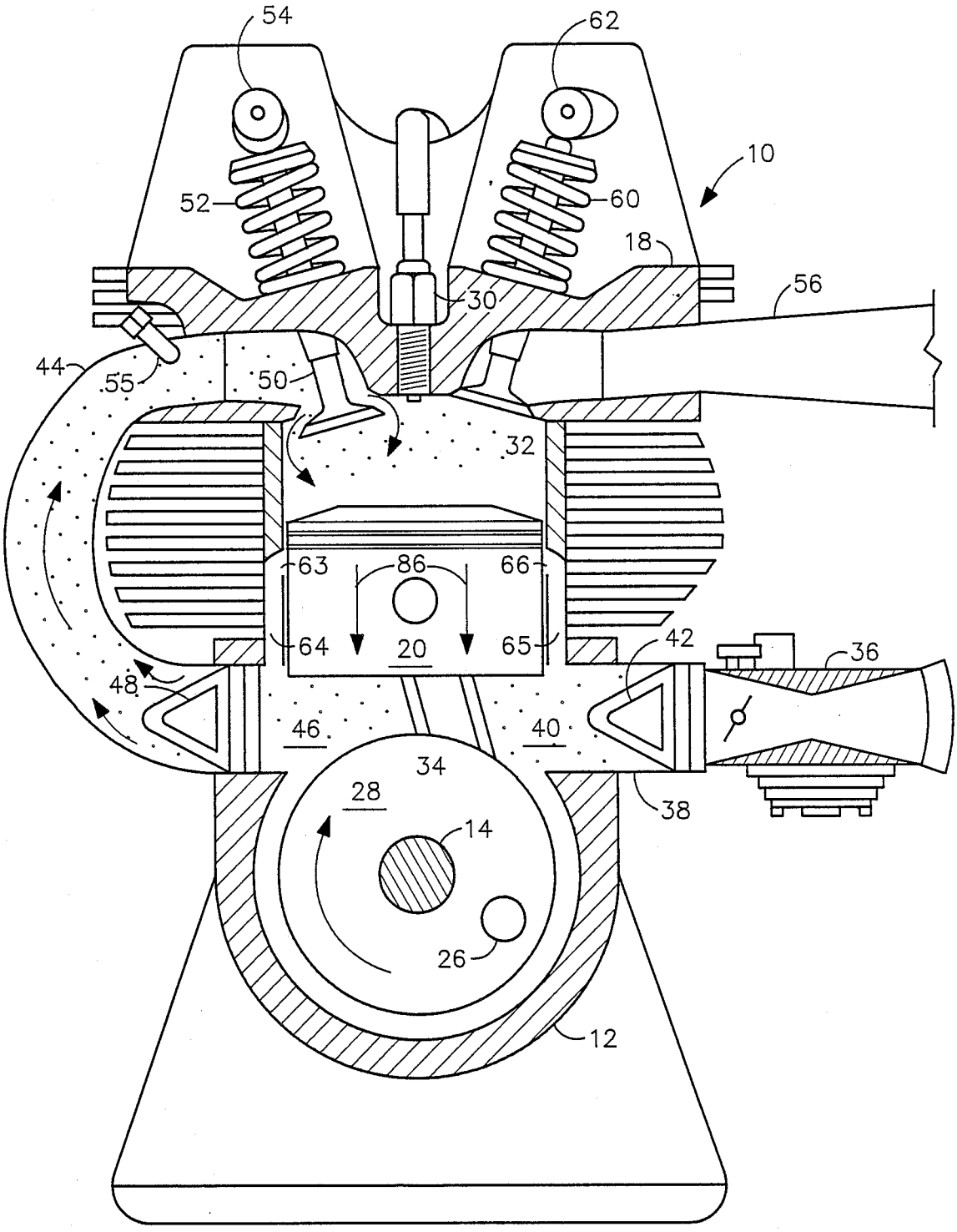
FIGS. 2A–F are a sequence of sectional elevation views of the engine of the present invention illustrating the operational sequence thereof.
Figure 2B:
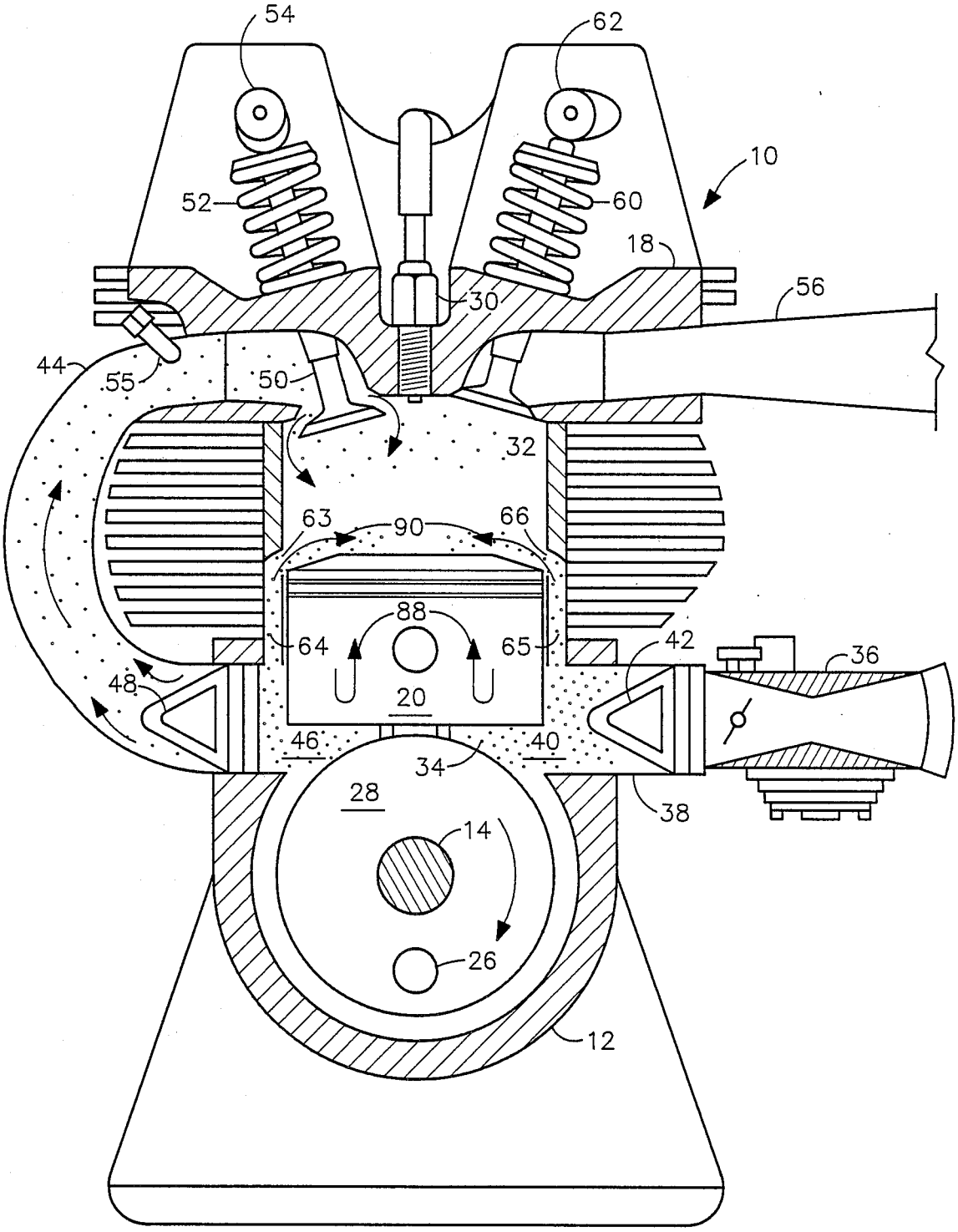
Figure 2C:
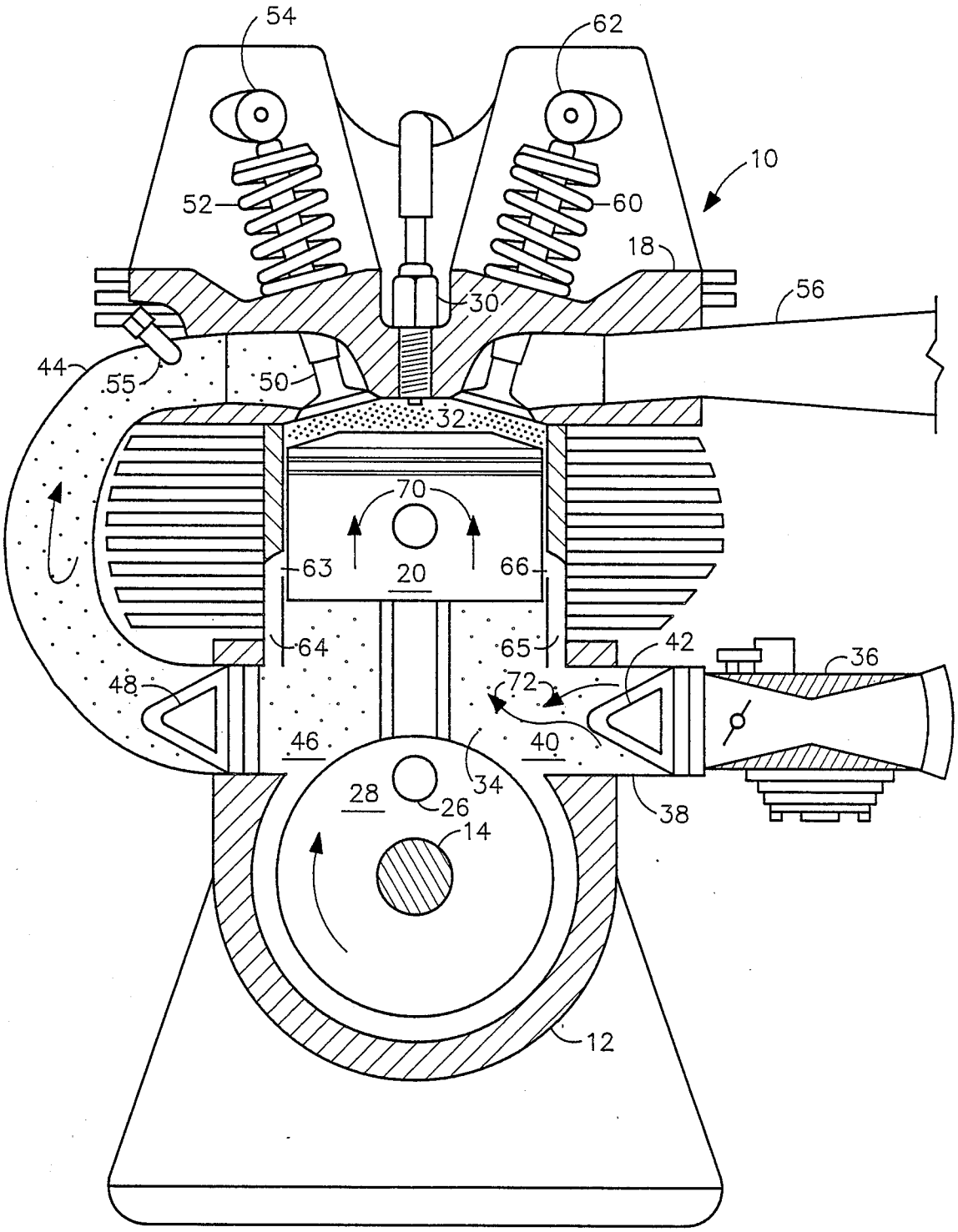
Figure 2D:
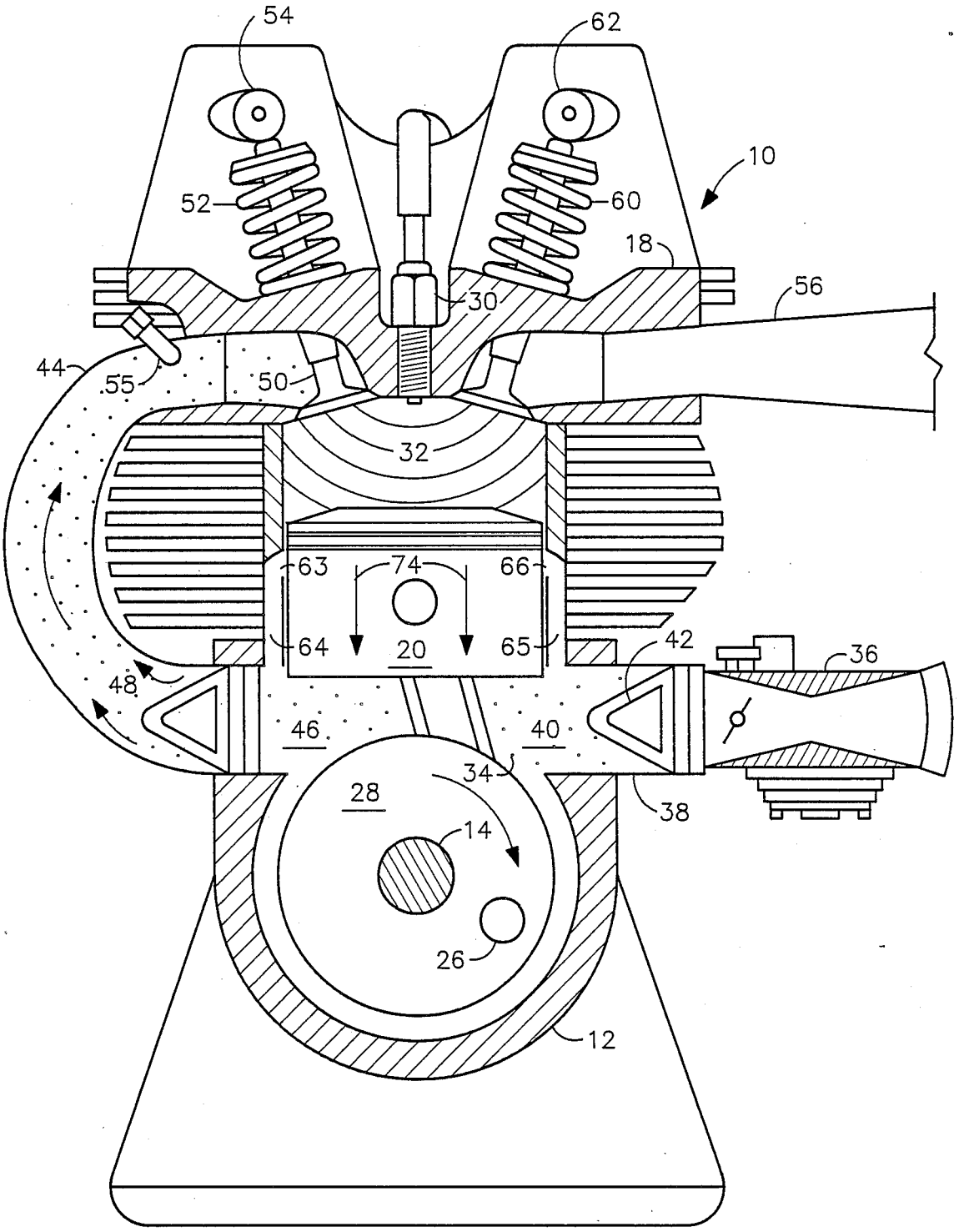
Figure 2E:
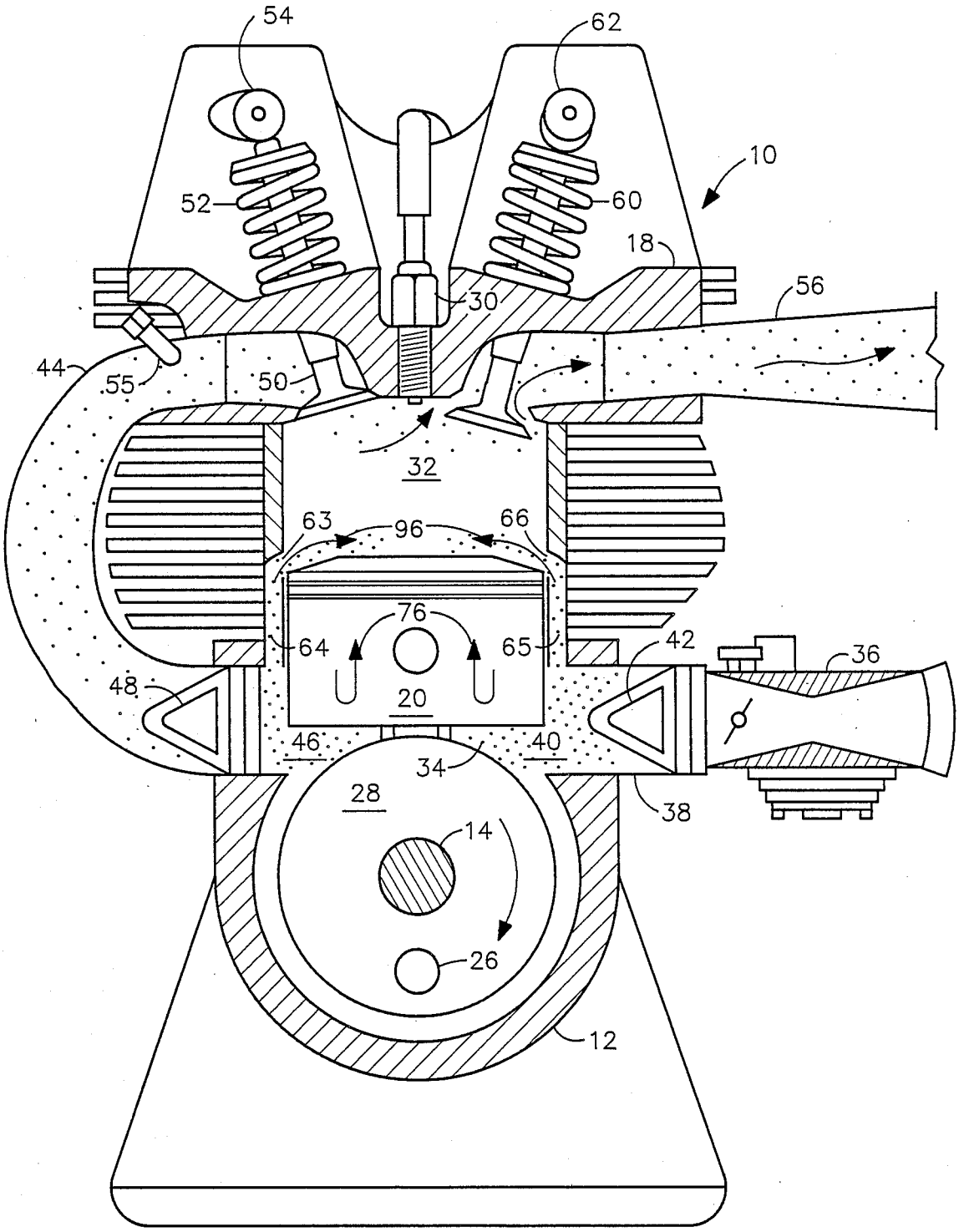
Figure 2F:
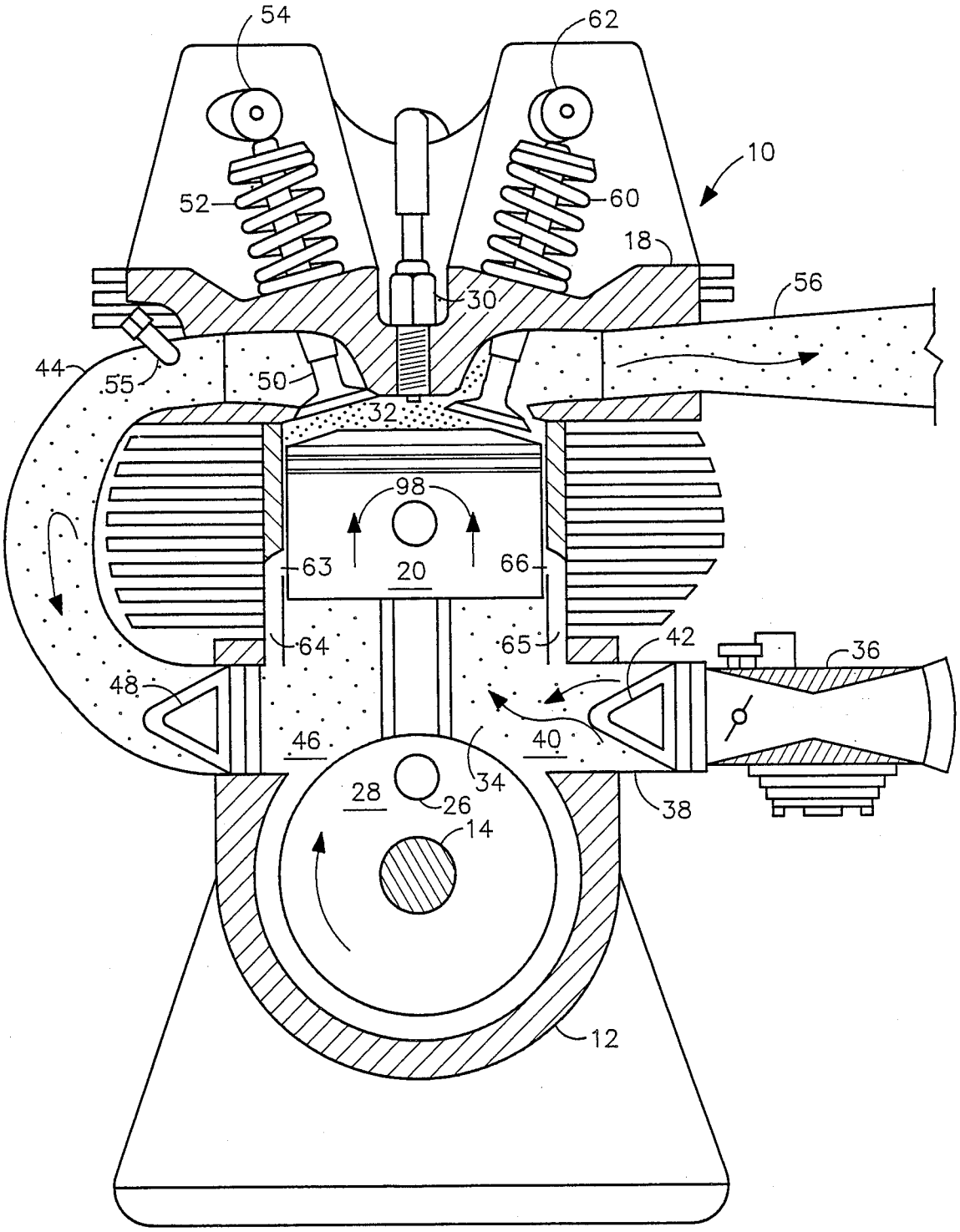

The operation of engine 10 is illustrated in FIGS. 2A–F in combination. FIG. 2A illustrates engine 10 with piston 20 moving through its intake stroke. FIG. 2B illustrates piston 20 at its bottom dead center position between its intake and compression strokes. FIG. 2C illustrates piston 20 completing its compression stroke, and FIG. 2D illustrates the piston during its power stroke. FIG. 2E illustrates piston 20 at its bottom dead center position between its power and exhaust strokes, and FIG. 2F illustrates piston 20 completing its exhaust stroke.

Starting with the compression stroke illustrated in FIG. 2C, piston 20 moves upwardly as illustrated by arrows 70 to its top dead center position. The upward movement of piston 20 creates a vacuum in the compression chamber 34, and a lean mixture (if carburetor 36 or other fuel mixing device is used) or air (if not) is drawn into compression chamber 34 through conduit 38 as illustrated by arrows 72 so that compression chamber 34 is filled with the lean mixture of air.

During the following power stroke of the piston, illustrated in FIG. 2D, piston 20 moves downwardly as illustrated by arrows 74 toward its bottom dead center position. The volume of compression chamber 34 is thus reduced, and reed valve 42 closes. The air or lean mixture drawn into compression chamber 34 during the compression stroke is forced into intake conduit 44 past reed valve 48 as illustrated by arrows 75. Intake valve 50 remains closed and the air or lean mixture is isolated from combustion chamber 32, and remains under pressure in conduit 44.

When piston 20 approaches its bottom dead center position at the end of its power stroke and begins its exhaust stroke, as illustrated by arrows 76 in FIG. 2E, supplemental intake ports 63, 66 are exposed to combustion chamber 32. The pressure in compression chamber 34 will exceed the pressure in combustion chamber 32, and air or lean mixture will be fed into combustion chamber 32 through conduits 64, 65 as illustrated by arrows 96.

The supplemental air or lean mixture injected into the region immediately overlying piston 20 will provide a cushion of fresh air or lean mixture between piston 20 and the combusted gasses which occupy the remainder of the cylinder to provide further oxidant to complete the combustion of any unburned charge, and purge the combustion chamber of contaminating exhaust residue as illustrated in FIG. 2F, simultaneously the upward movement of piston 20 during the exhaust stroke creates a vacuum in compression chamber 34 drawing in a fresh charge of air or air/fuel mixture through air throttle or fuel mixing device 36.

During the initiation of the subsequent intake stroke, illustrated in FIG. 2A the pressure within intake conduit 44 will exceed that within a compression chamber 34, and reed valve 48 will remain closed. However, as piston 20 travels downwardly to its bottom dead center position, the reduction of volume in compression chamber 34 together with the expansion in combustion chamber 32 will result in the pressure within the compression chamber exceeding that in intake conduit 44, causing reed valve 48 to open and the air or air/fuel mixture within compression chamber 34 to move into intake conduit 44. Injector 55 is actuated to inject fuel into the air or lean mixture as it passes from intake conduit 44 into combustion chamber 32 to provide a mixture which is sufficiently rich to ignite easily.

As piston 20 reaches the bottom of its intake stroke and initiates its compression stroke, as illustrated in FIG. 2B, piston 20 changes directions as illustrated by arrows 88. Piston 20 is near its bottom dead center position, so that supplemental intake ports 63, 66 are exposed. In a static situation, the pressure immediately above piston 20 in combustion chamber 32 would equal that immediately below the piston in compression chamber 34. However, because of the accelerated movement of piston 20, particularly at high piston speeds, a partial vacuum is created in combustion chamber 32 immediately above the piston. As a result, a compressed air or lean mixture stored in compression chamber 34 will be forced upwardly through conduits 64, 65 and injected into combustion chamber 32 immediately above piston 20, as illustrated by arrows 90.

During the compression stroke of the piston, as illustrated in FIG. 2C, the combustible charge in combustion chamber 32 is compressed further by the upward movement of the piston. At about the top dead center position of the piston, spark plug 30 fires, driving piston 20 downwardly during the power stroke illustrated in FIG. 2D.

The air or lean mixture entering combustion chamber 32 through intake conduit 44 is enrichened by fuel supplied through injector 55. Adjacent the upper surface of combustion chamber 32, this mixture will be diluted by the supplemental air or lean mixture entering combustion chamber 32 through ports 63, 66. This results in a stratified charge which is richer near the top of the combustion chamber and more lean adjacent the piston.

A richer mixture is needed for ignition than is desirable for complete combustion. Accordingly, a stratified charge in which the mixture is relatively rich near the point of ignition, but more lean in the remainder of the combustion chamber, is more efficient, and results in more complete combustion. Combustion is also enhanced by the present invention in that the material entering combustion chamber 32 from opposite directions increases turbulence in the mixture, further facilitating complete combustion. The ultimate result is more power, better economy, and lower emissions.

Figure 3:
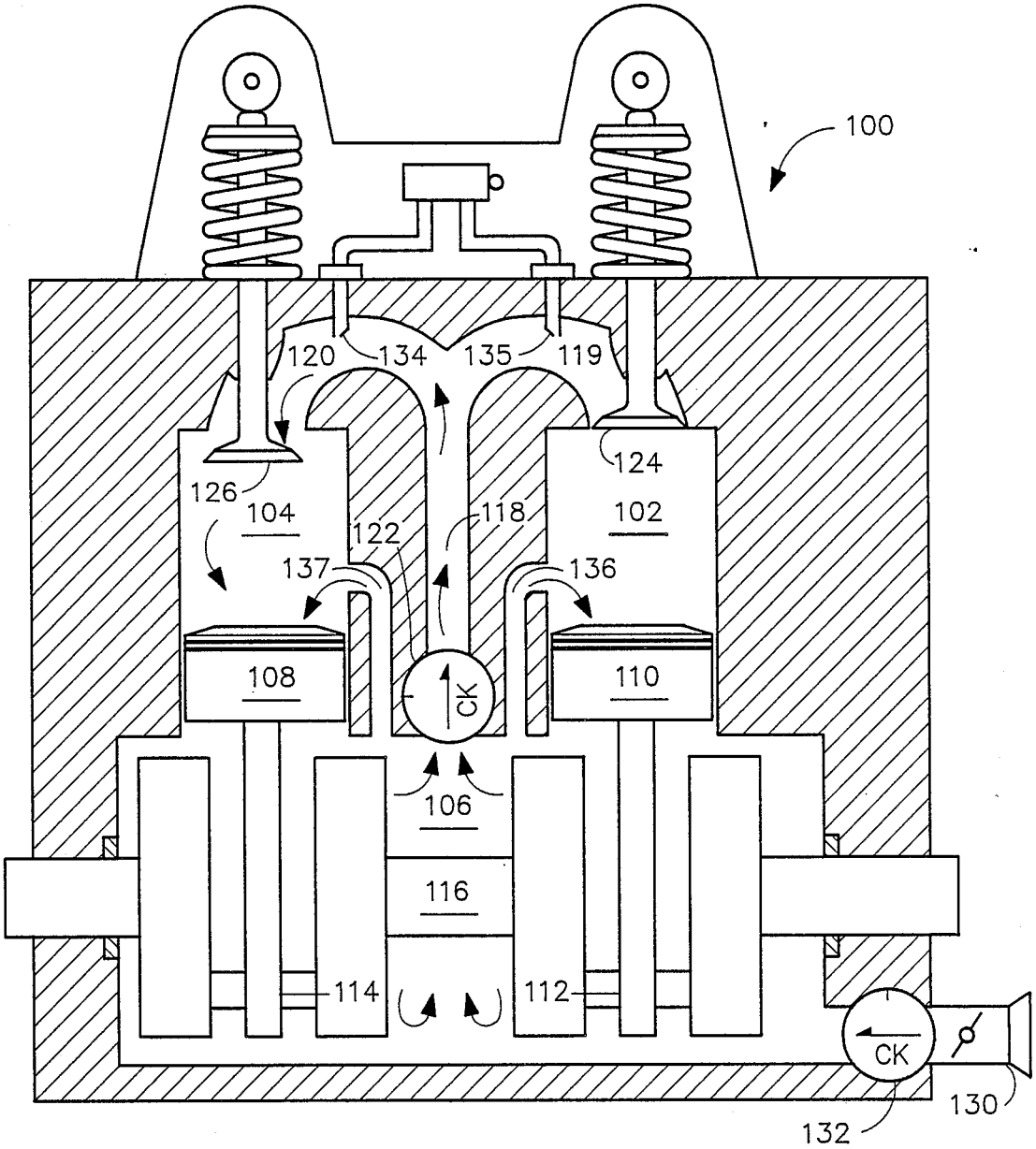
FIG. 3 is a side sectional elevational schematic view of a two-cylinder engine constructed in accordance with the teachings of the present invention.

A two-cylinder embodiment 100 of the present invention is illustrated by way of reference to FIG. 3. A pair of cylinders 102, 104 open into a common crankcase 106. Pistons 108, 110 reciprocate in respective cylinders 102, 104, and depending piston rods 112, 114 connect the pistons to a common crank 116.

An intake conduit 118 emanates from crankcase 106, and has separate branches 119, 120 terminating in cylinders 102, 104 respectively. A check valve 122 prevents reverse flow from intake conduit 118 to crankcase 106. Actuatable intake valves 124, 126 are interposed in the branches 119, 120 of intake conduit 118 to control flow fluid from the intake conduit to the combustion chambers at the upper ends of cylinders 102, 104.

In engine 100, pistons 108, 110 move in unison. However, their strokes are offset so that when piston 108 is in its intake stroke, piston 100 is in its power stroke, and all other strokes are offset in the same fashion.

An inlet conduit 130 allows air or a lean mixture to enter crankcase 106, and check valve 132 prevents its escape. When pistons 108 and 110 move upwardly, air or lean mixture is drawn into the crankcase, and when the pistons begin to move downwardly, the air or lean mixture is compressed in the crankcase and forced into intake conduit 118, bypassing check valve 122.

During the downward movement of the pistons 108, 110, one of the pistons (but not the other) is in its intake stroke, and the intake valve 124, 126 associated with that piston is opened. The air or lean mixture from crankcase 106 is thus compressed in the cylinder associated with the piston which is undergoing its intake stroke. Fuel injectors 134, or 135, accordingly inject fuel into the air or lean mixture and provide a combustible charge above the intaking piston.

Two-cylinder engine 100 also includes a pair of secondary conduits 136, 137. As in the single cylinder embodiment illustrated previously is that a relatively continuous flow is established through intake conduit 118. In contrast, the flow of fluid through intake conduit in the single cylinder embodiment stagnates through three strokes of the piston, accelerating rapidly during the fourth stroke, which can upset mixture distribution, and impede intake track velocity.

While preferred embodiments of the present invention have been illustrated in detail, it is apparent that modifications and adaptations of those embodiments will occur to those skilled in the art. For example, various other multicylinder engine concepts could be employed, such as one with the crankcase isolated into segments. However, it is to be expressly understood that such modifications and adaptations are within the scope of the present invention, as set forth in the following claims.

What is claimed is:

1. A high power, low-emission, fuel efficient, supercharged, four-stroke 6 cycle engine comprising:

means for defining a chamber having a cylindrical portion;

a piston which reciprocates in the cylindrical portion of the chamber through successive intake, compression, power and exhaust strokes respectively while six different cycles or events take place and divides the chamber into a combustion chamber and a compression chamber;

means for supplying air to the compression chamber during the compression and exhaust strokes of the piston;

a compression chamber inlet valve to prevent reverse flow back out of the compression chamber;

an intake conduit providing fluid communication between the compression chamber and the combustion chamber;

a compression chamber outlet valve interposed in the intake conduit proximate the compression chamber to prevent reverse flow from the intake conduit to the compression chamber but allows flow from the compression chamber into the intake conduit during the intake and power strokes of the piston;

an active intake valve operable to allow fluid communication from the intake conduit into the combustion chamber during the intake stroke of the piston;

means for mixing fuel with the air as it passes from the compression chamber to the combustion chamber through the intake conduit to provide a compressed combustible charge which is injected into the combustion chamber at greater than atmospheric pressure during the intake stroke of the piston; and at least one secondary conduit providing fluid communication from the compression chamber to the interior of the combustion chamber through a secondary port located so that the port is blocked by the piston except near the bottom dead center position of the piston in order that supplemental air is fed into the combustion chamber immediately above the piston at the end of the intake stroke and beginning of the compression stroke through the secondary port to provide a stratified charge in the combustion chamber, and further secondary air is fed into the combustion chamber at the end of the power stroke and beginning of the exhaust stroke to enhance complete combustion of combusted charge.

2. An engine as recited in claim 1 wherein said supply means includes means for mixing supplemental fuel with the air supplied to the compression chamber to provide a lean mixture, a portion of said lean mixture passing into the combustion chamber through the intake conduit in which the mixture is enriched by the fuel mixing means, the remainder of said lean mixture passing into the combustion chamber through the secondary conduits.

3. An engine as recited in claim 1 wherein said fuel mixing means comprises a fuel injector.

4. A high power, low emission, supercharged, four-stroke, 6 cycle engine comprising:

means for defining a chamber having a cylindrical portion;

a piston which reciprocates in the cylindrical portion of the chamber through successive intake, compression, power and exhaust strokes respectively and divides the chamber into a combustion chamber and a compression chamber;

means for supplying a mixture of fuel and air to the compression chamber during the compression and exhaust strokes of the piston;

an intake conduit providing fluid communication between the compression chamber and the combustion chamber;

a compression chamber outlet valve interposed in the intake conduit proximate the compression chamber to prevent reverse flow from the intake conduit to the compression chamber but allows flow from the compression chamber to the intake conduit during the intake and power strokes of the piston;

an active intake valve operable to allow fluid communication from the intake conduit into the combustion chamber during the intake stroke of the piston;

means for adding fuel to the lean mixture as it passes from the compression chamber to the combustion chamber through the intake conduit to provide a compressed combustible charge which is injected into the combustion chamber during the intake stroke of the piston; and at least one secondary conduit providing fluid communication from the compression chamber to a secondary intake port located in the lower portion of said combustion chamber, activity of said port thereby controlled and timed by the movement of the piston within the combustion chamber so that a portion of the lean mixture is fed into the combustion chamber immediately above the piston at the end of the intake stroke and beginning of the compression stroke through the secondary port to provide a stratified charge in the combustion chamber, and a further portion of secondary air is fed into the combustion chamber at the end of the power stroke and beginning of the exhaust stroke to enhance complete combustion and exhaustion of the combustion charge;

whereby the air being delivered to the lower portion of the combustion chamber through the secondary intake conduit and ports is provided with a fuel injector or other fuel mixing means, thereby affording a greater degree of fuel mixture control during the creation of the stratified charge.

5. An engine as recited in claim 1 or 4 and additionally comprising an active exhaust valve operable to allow fluid communication of the combusted charge from the combustion chamber during the exhaust stroke of the piston.

6. An engine as recited in claim 1 or 4 wherein the active intake valve comprises a poppet valve.

7. An engine as recited in claim 4 wherein the lean mixture supplying means includes a carburetor.

8. An engine as recited in claim 4 wherein the fuel adding means comprises a fuel injector.

9. A high power, low emission, supercharged, four-stroke, 6 cycle engine comprising:

means for defining a chamber having a pair of cylindrical portions;

a pair of pistons, one of said pair of pistons reciprocating in each of the respective cylindrical portions of the chamber and separate the chamber into a pair of discrete combustion chambers and a common compression chamber, each of the pistons moving in phase with one another, one piston being on its intake stroke while the other piston is on its power stroke;

means for supplying air to the compression chamber during the compression and exhaust strokes of the pistons;

an intake conduit providing common fluid communication between the compression chamber and the combustion chambers;

a compression chamber outlet valve interposed in the intake conduit proximate the compression chamber to prevent reverse flow from the intake conduit during the compression and exhaust strokes of the pistons;

active intake valve means operable to allow fluid communication from the intake conduit into the combustion chambers during the intake stroke of each piston;

means for mixing fuel with the air as it passes from the compression chamber to the combustion chambers through the intake conduit to provide a compressed combustible charge which is injected into each combustion chamber at greater than atmospheric pressure during the intake stroke of the associated piston; and secondary conduit means providing fluid communication from the compression chamber to a secondary intake port located in the lower portion of said combustion chambers, activity of said port thereby controlled and timed by the movement of the pistons within the combustion chambers in order that supplemental air is fed into the combustion chambers immediately above the pistons at the end of the intake stroke and beginning of the compression stroke of each piston through the secondary ports to provide a stratified charge in the combustion chambers, and further secondary air is fed into the combustion chambers at the end of the power stroke and beginning of the exhaust stroke of each piston to enhance complete combustion of the combusted charge.

10. An engine as recited in claim 9 wherein said supply means includes means for mixing supplemental fuel with the air supplied to the combustion chamber to provide a lean mixture, a portion of said lean mixture passing into the combustion chambers through the intake conduit in which the mixture is enriched by the fuel mixing means, the remainder of said lean mixture passing into the combustion chambers through the secondary conduit means.

11. An engine as recited in claim 4 or 9 and additionally comprising a crank located within the compression chamber and operably connected to each piston.

12. An engine as recited in claim 1, 4 or 9 wherein a check valve is provided in the secondary conduit in order to prevent reverse flow into the compression chamber.

13. An engine as recited in claim 1 or 4 wherein said chamber has two of said cylindrical portions and two of said pistons, one of said two pistons reciprocating in each of the respective chambers in phase with one another, one piston being on its intake stroke while the other piston is on its power stroke, said pistons dividing the chamber into a pair of discrete combustion chambers and a common compression chamber; said intake conduit providing common fluid communication between the discrete combustion chambers and the compression chamber; wherein two of said intake valves allow fluid communication from the intake conduit into the respective combustion chambers during the intake stroke of the associated pistons; and two secondary conduits, one of said secondary conduits providing fluid communication to each of the respective combustion chambers.

14. An engine as recited in claim 1 or 4 wherein said compression chamber's inlet or outlet valve comprises either a passive check valve, or an active timed valve.

15. An engine as recited in claim 1 or 4 wherein at least one secondary conduit providing fluid communication from the compression chamber to a secondary intake port located in the lower portion of said combustion chamber, activity of said port thereby controlled and timed by the movement of the piston within the combustion chamber.

16. An engine as recited in claim 1, 4, or 9 wherein the introduction of fuel is initiated within the combustion chamber by means of a fuel injector or other means of introducing fuel directly into the combustion chamber.

* * * * *